US007682054B2

(12) United States Patent
Hsu et al.

(10) Patent No.: US 7,682,054 B2
(45) Date of Patent: Mar. 23, 2010

(54) ILLUMINATING APPARATUS WITH EFFICIENT HEAT DISSIPATION CAPABILITY

(75) Inventors: Hung-Kuang Hsu, Miao-Li Hsien (TW); Wen-Jang Jiang, Miao-Li Hsien (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

(21) Appl. No.: 12/045,156

(22) Filed: Mar. 10, 2008

(65) Prior Publication Data

US 2009/0067182 A1 Mar. 12, 2009

(30) Foreign Application Priority Data

Sep. 11, 2007 (CN) ..... 2007 1 0201647

(51) Int. Cl.
*F21V 29/00* (2006.01)

(52) U.S. Cl. ..... 362/373; 362/294

(58) Field of Classification Search ..... 362/294, 362/345, 373, 547, 437
See application file for complete search history.

(56) References Cited

U.S. PATENT DOCUMENTS 4,630,182 A * 12/1986 Moroi et al. ..... 362/294
5,947,592 A * 9/1999 Barlow ..... 362/345
6,183,114 B1 * 2/2001 Cook et al. ..... 362/294
7,144,135 B2 * 12/2006 Martin et al. ..... 362/294

FOREIGN PATENT DOCUMENTS

CN 1924436 A 3/2007

OTHER PUBLICATIONS

Steigerwald et al., Illumination With Solid state Lighting Technology, IEEE Journal on Selected Topics in Quantum Electronics, vol. 8, No. 2, Mar./Apr. 2002.

* cited by examiner

*Primary Examiner*—John A Ward
(74) *Attorney, Agent, or Firm*—Andrew C. Cheng

(57) ABSTRACT

An illuminating apparatus (20) includes a lamp cover (200), a solid-state light emitting component (23) and an air tank (24). The lamp cover has a first end and an opposite second end. The lamp cover tapers from the first end to the second end. The lamp cover defines therein an air channel (25) running from the first end to the second end of the lamp cover. The solid-state light emitting component is disposed in the lamp cover at the second end thereof. The air tank has a chamber (240) therein in thermally contact with the solid-state light emitting component. The air tank has a plurality of first and second air vents (244, 245). The chamber is communicated with the air channel via the first air vents, and is communicated with an ambient environment via the second air vents. The first and second air vents are disposed at different altitudes.

6 Claims, 11 Drawing Sheets

ILLUMINATING APPARATUS WITH EFFICIENT HEAT DISSIPATION CAPABILITY

BACKGROUND

1. Technical Field

The present invention relates generally to illuminating apparatuses, and particularly to an illuminating apparatus using principles of natural ventilation for improving heat dissipation efficiency.

2. Description of Related Art

With the continuing development of scientific technology, light emitting diodes (LEDs) have been widely used in the field of illumination due to its high brightness, long service lifetime, wide color gamut and so on. Relevant subject matter is disclosed in an article entitled "Illumination With Solid-state Lighting Technology", published on IEEE Journal on Selected Topics in Quantum Electronics, Vol. 8, No. 2, authored by Daniel A. Steigerwald et al. in March/April, 2002, the disclosure of which is incorporated herein by reference.

LEDs generally emit visible light at specific wavelengths and generate a significant amount of heat. Generally, approximately 80-90% of the power energy consumed by the LEDs is converted to heat, with the remainder of the power energy converted to light. If the generated heat cannot be timely removed, LEDs may overheat, and thus their performance and service lifetime may be significantly reduced.

Referring to FIG. 11, U.S. Pat. No. 7,144,135 discloses an LED lamp 10 which includes an exterior shell 11 and an interior, an optical reflector 12 disposed in the shell 11. The shell 11 and the optical reflector 12 define a space therebetween for severing as an air channel 13 to cool the LED lamp 10. The shell 11 has a truncated conical shape which defines an opening 111 at a wider end thereof. A narrower end of the shell 11 is connected to an AC/DC converter 15. The narrower end of the shell 11 defines a plurality of air vents 16 for severing as air intake holes for the LED lamp 10. An LED 14 is located at the bottom end of the optical reflector 12 and mounted to a heat sink 17. The heat sink 17 is disposed in the shell 11. A motor 18 is mounted to a bottom of the heat sink 17 for severing as drive a fan 19. The fan 19 moves air over the heat sink 17 from the plurality of air vents 16 and through the air channel 13 defined between the shell 11 and the optical reflector 12 and flowing outside the LED lamp 10 for heat dissipation.

However, when the motor 18 operates, additional energy is required to drive the motor 18. This is not favorable to save energy. In addition, a probability of malfunction of the LED lamp 10 will be increased due to the use of the motor 18 and the fan 19.

What is needed, therefore, is an illuminating apparatus which can overcome the above-mentioned disadvantages.

SUMMARY

The present invention relates to an illuminating apparatus. According to a preferred embodiment of the present invention, the illuminating apparatus includes a lamp cover, a solid-state light emitting component and an air tank. The lamp cover has a first end and an opposite second end. The lamp cover tapers from the first end to the second end. The lamp cover defines therein an air channel running from the first end to the second end of the lamp cover. The solid-state light emitting component is disposed in the lamp cover at the second end thereof. The air tank has a chamber therein in thermally contact with the solid-state light emitting component. The air tank has a plurality of first and second air vents. The chamber is communicated with the air channel via the first air vents, and is communicated with an ambient environment via the second air vents. The first and second air vents are disposed at different altitudes.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
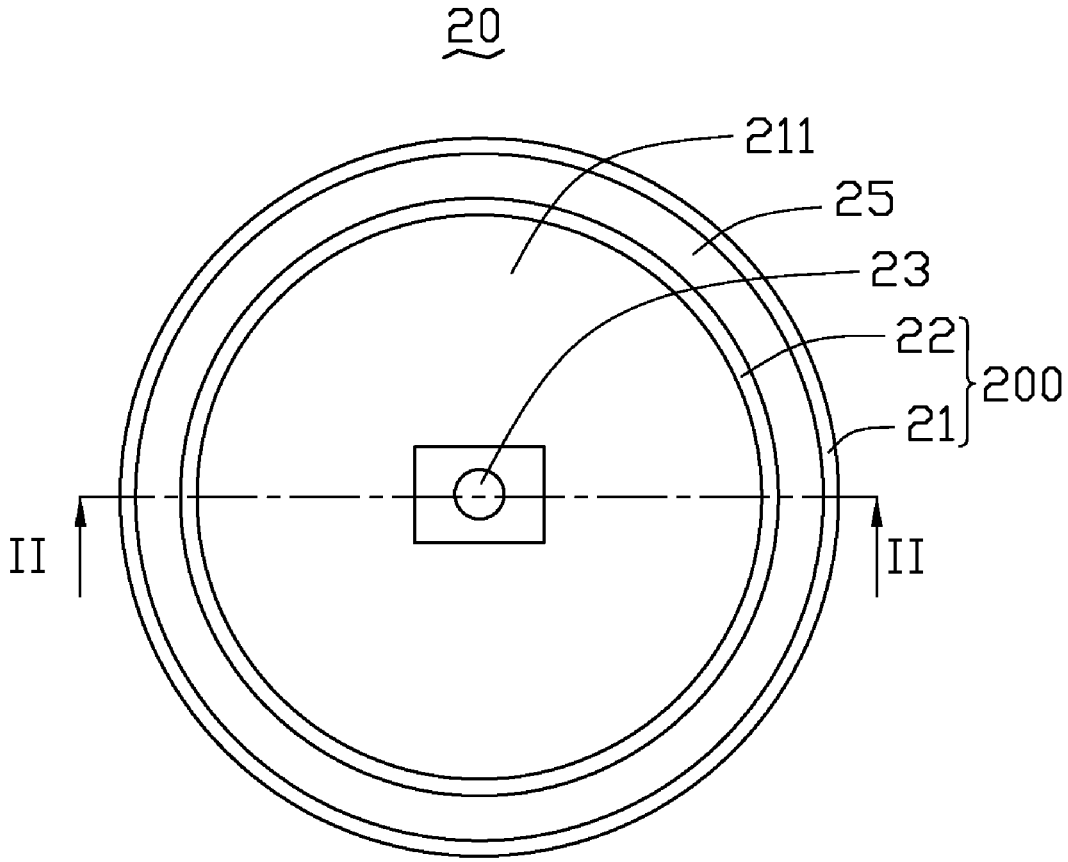
FIG. 1 is a top plan view of an illuminating apparatus in accordance with a first preferred embodiment of the present invention.
Figure 2:
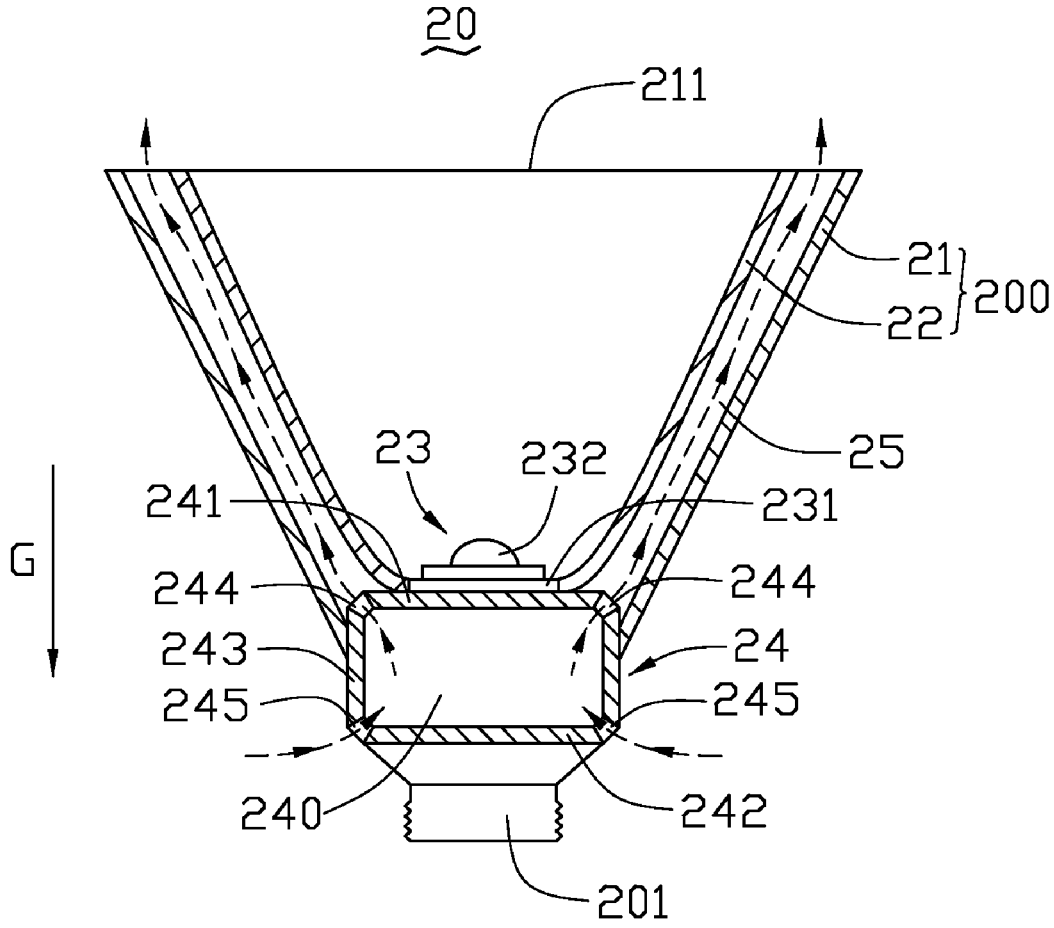
FIG. 2 is a cross-sectional view of the illuminating apparatus in an upright position of FIG. 1, taken along line II-II thereof.

Referring to FIGS. 1 and 2, an illuminating apparatus 20 in accordance with a first preferred embodiment of the present invention includes a lamp cover 200, a solid-state light emitting component disposed in the lamp cover 200, and an air tank 24 engaged with the lamp cover 200. In this embodiment, the solid-state light emitting component is an LED 23, such as a semiconductor LED or an organic LED (OLED).

The lamp cover 200 includes an exterior shell 21 and an interior shell 22 aligned inside the exterior shell 21. The exterior shell 21 has a truncated conical shape and is hollow, defining an opening 211 at the wider end and the narrower end of the exterior shell 21 being contacted with the air tank 24. Specifically, the air tank 24 is partially disposed in an inner surface of the narrower end. The interior shell 22 is an optical reflector, such as a total internal reflector (TIR), to redirect the direction of the light emitted from the LED 23. The exterior shell 21 and the interior shell 22 define a circular space 25 therebetween for severing as an air channel.

The LED 23 is disposed at a bottom end of the interior shell 22. The LED 23 has a base 231 and a light emitting portion 232 configured on the base 231, with a bottom surface of the base 231 thermally contacted with the air tank 24. If desired, thermal grease may be applied between the bottom surface of the base 231 and the air tank 24 to improve heat conduction. Furthermore, although the illuminating apparatus 20 shown only includes a single LED 23, it should be understood that if desired, a plurality of LEDs may be adopted to generate a predetermined brightness or a predetermined color of the light emitting out of the illuminating apparatus 20.

The air tank 24 is substantially a hollow cylinder. The air tank 24 includes a top wall 241, a bottom wall 242 at opposite end of the air tank 24 and a cylindrical side wall 243 connecting the top wall 241 with the bottom wall 242. The top wall 241, the bottom wall 242 and the cylindrical side wall 243 further cooperatively define a chamber 240 in the air tank 24. The top wall 241 is thermally contacted with the bottom surface of the base 231 of the LED 23. The side wall 243 is engaged with the narrower end of the exterior shell 21.

The air tank 24 defines a plurality of first air vents 244 (only two first air vents are shown in FIG. 2) at an intersection between the top wall 241 and the side wall 243, and a plurality of second air vents 245 (only two second air vents are shown in FIG. 2) at an intersection between the bottom wall 242 and the side wall 243. Each first air vent 244 communicates with the chamber 240 of the air tank 24 and the space 25 defined between the exterior shell 21 and the interior shell 22, and each second air vent 245 communicates with the chamber 240 and an ambient environment. A diameter of the first air vent 244 substantially equals to that of the second air vent 245. Furthermore, it should be understood that if a single first air vent and a single second air vent are defined instead of the plurality of first and second air vents 244, 245, each of the first and second air vents should have a relatively large diameter to allow an adequate airflow flux to pass through therefrom. Moreover, it should be also understood that the first and second air vents 244, 245 of the air tank 24 are not limited to the above-described locations. The first and second air vents 244, 245 may also be defined at other locations of the air tank 24 so long as the first air vents 244 and the second air vents 245 are disposed at different altitudes.

A female socket 201 is engaged with the bottom wall 242 of the air tank 24. The socket 201 is threaded and configured for connecting to a male socket (not shown) of a power supply (not shown).

The heat generated from the LED 23 is transferred into the air tank 24, and then exits from the illuminating apparatus 20 using principles of natural ventilation. Reference will now be made to describe the principle of natural ventilation in detail.

Natural ventilation, unlike fan-forced ventilation, uses the natural forces of wind and buoyancy to deliver fresh air into buildings for reducing interior temperature. Buoyancy ventilation may be temperature-induced (stack ventilation) or humidity-induced (cool tower). In this embodiment, the temperature-induced ventilation is adopted. An expression for the temperature-induced ventilation is:

$$Q=C*A[2g*h(Ti-To)/Ti]^{1/2}, \text{wherein}$$

Q=ventilation rate ($m^3/s$);

C=0.65, a discharge coefficient;

A=cross-sectional area of the inlet opening ($m^2$), which equals to cross-sectional area of the outlet opening;

g=9.807 ($m/s^2$), a gravitational acceleration;

h=vertical distance between a midpoint of the inlet opening and a midpoint of an outlet opening (m);

Ti=average temperature of indoor air (K);

To=average temperature of outdoor air (K).

When the illuminating apparatus 20 operates, the heat generated from the LED 23 is transferred into the air tank 24 through the top wall 241 of the air tank 24. The heat warms the air in the chamber 240 of the air tank 24. Warm air is lighter than cool air so that a buoyancy of the air in the air tank 24 is generated. Warm air rises towards the top wall 241 of the air tank 24 due to the buoyancy and exit through the first air vents 244 into the space 25. Warm air then continues to rise along the space 25 and exits into the ambient environment, removing the heat from the illuminating apparatus 20 into the ambient environment in the process. Simultaneously, cool air in the ambient environment is absorbed into the air tank 24 through the second air vents 245 to replace warm air in the air tank 24. Thus, an air circulatory system is formed between the air in the air tank 24 and the ambient environment through the first air vents 244, the second air vents 245 and the space 25 for heat dissipation. The flow of air is illustrated in FIG. 2 by dashed arrows. At this time, the first air vents 244 and the second air vents 245 are used as air exhausting holes and air intake holes, respectively.

The illuminating apparatus 20 has a better heat dissipating efficiency, because the illuminating apparatus 20 does need consume additional energy, such as, to drive a motor and a fan. Furthermore, a fan and a motor are not required, thereby reducing a probability of malfunction of the illuminating apparatus 20.

Alternatively, the illuminating apparatus 20 in accordance with the first preferred embodiment of the present invention may be rotated at different inclined angles from the upright position. Warm air in the air tank 24 will selectively exit from the first air vents 244 or/and the second air vents 245 at higher altitudes in the air tank 24. Cool air in the ambient environment will be absorbed into the air tank 24 selectively through the second air vents 245 or/and the first air vents 244 at lower altitudes in the air tank 24.

Figure 3:
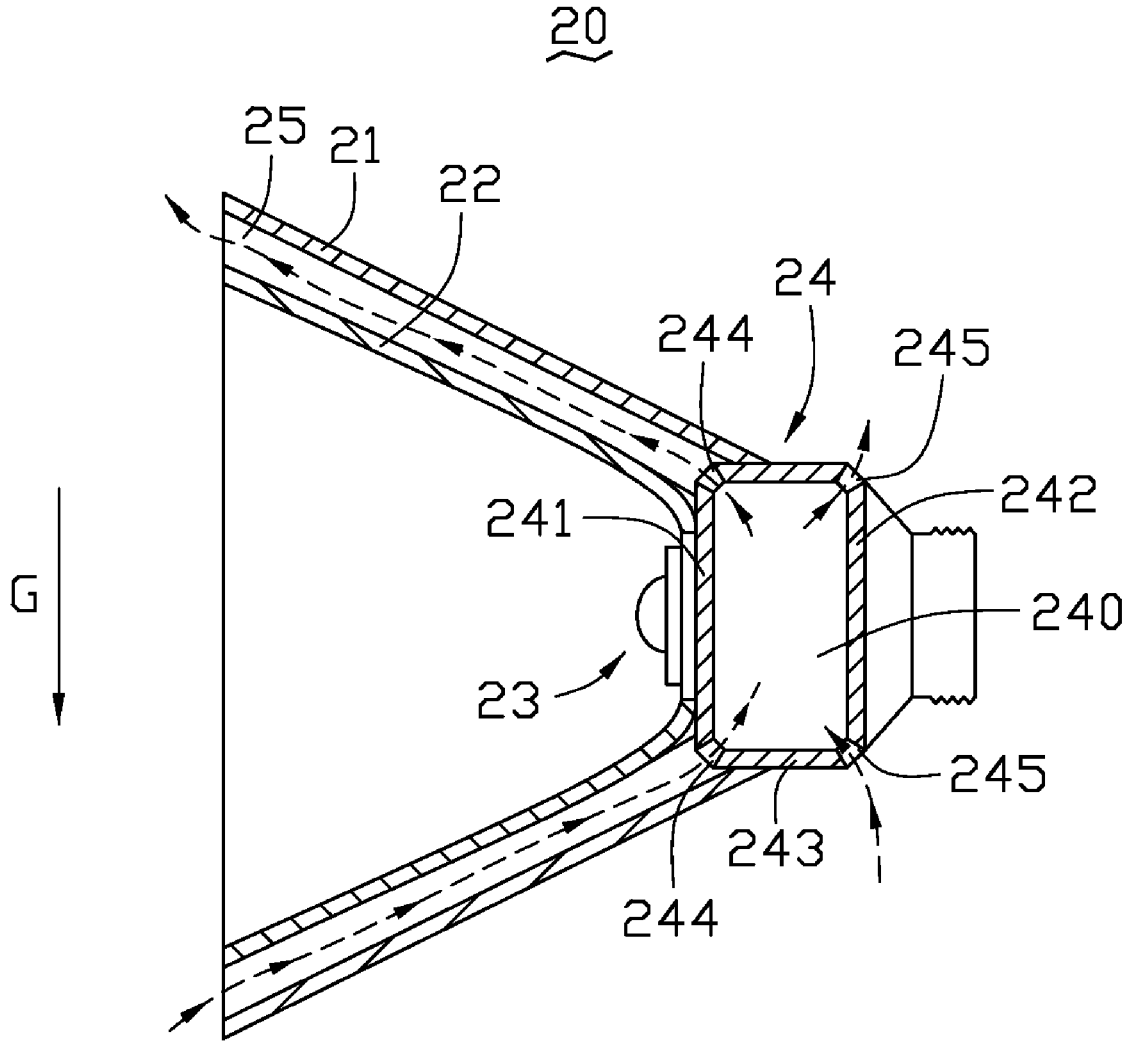
FIG. 3 is a cross-sectional view of the illuminating apparatus of FIG. 1, with the illuminating apparatus in a horizontal position rotated 90 degrees from the upright position.

Referring to FIG. 3, the illuminating apparatus 20 is positioned in a horizontal position rotated 90 degrees from the upright position. Warm air in the tank 24 travels to the space 25 through the first air vents 244 at higher altitudes, and then enters into the ambient environment for dissipating heat away from the illuminating apparatus 20. Warm air in the tank 24 can also directly exit out of the air tank 24 through the second air vents 245 at higher altitudes to the ambient environment for dissipating heat away from the illuminating apparatus 20. Simultaneously, cool air in the ambient environment is absorbed into the air tank 24 through the first air vents 244 at lower altitudes. Cool air in the ambient environment can also directly be absorbed into the air tank 24 through the second air vents 245 at lower altitudes. At this time, the first air vents 244 and the second air vents 245 at higher altitudes are used as air exhausting holes. The first air vents 244 and the second air vents 245 at lower altitudes are used as air intake holes.

Figure 4:
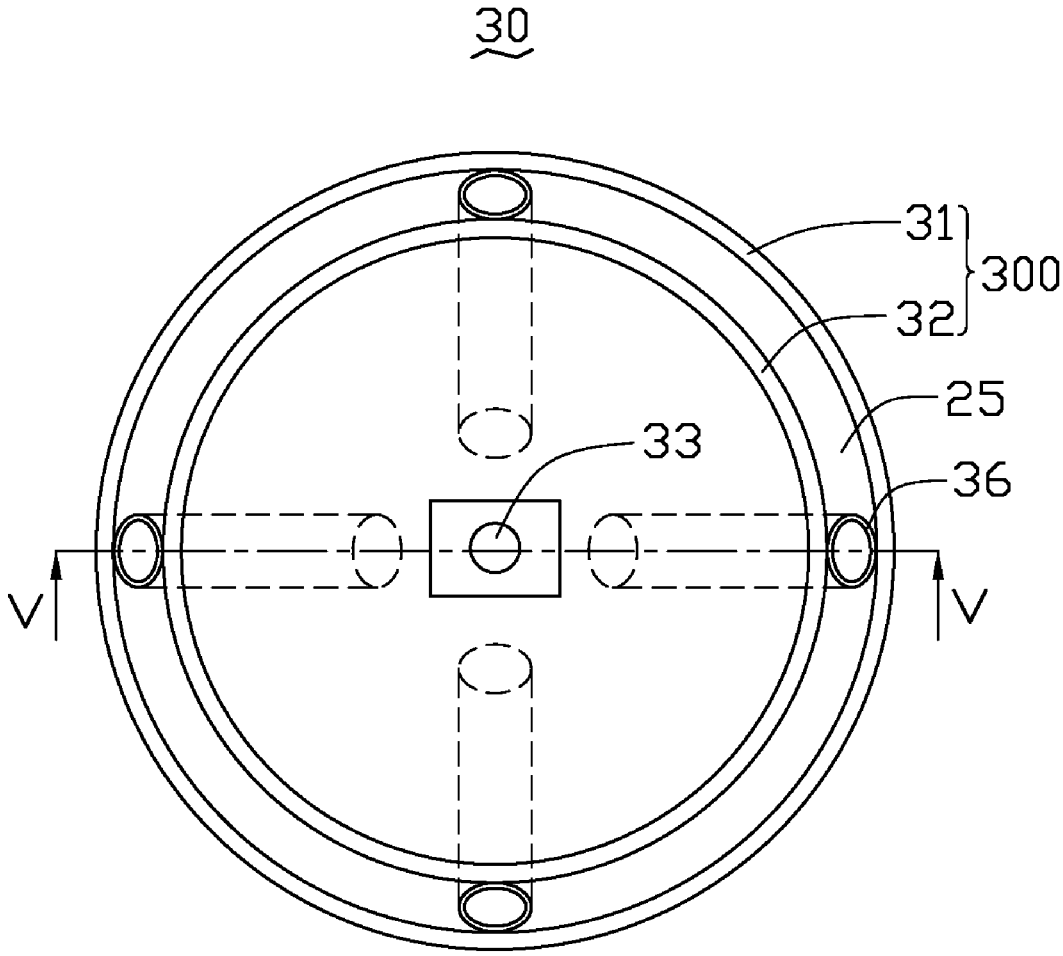
FIG. 4 is a top plan view of an illuminating apparatus in accordance with a second preferred embodiment of the present invention.
Figure 5:
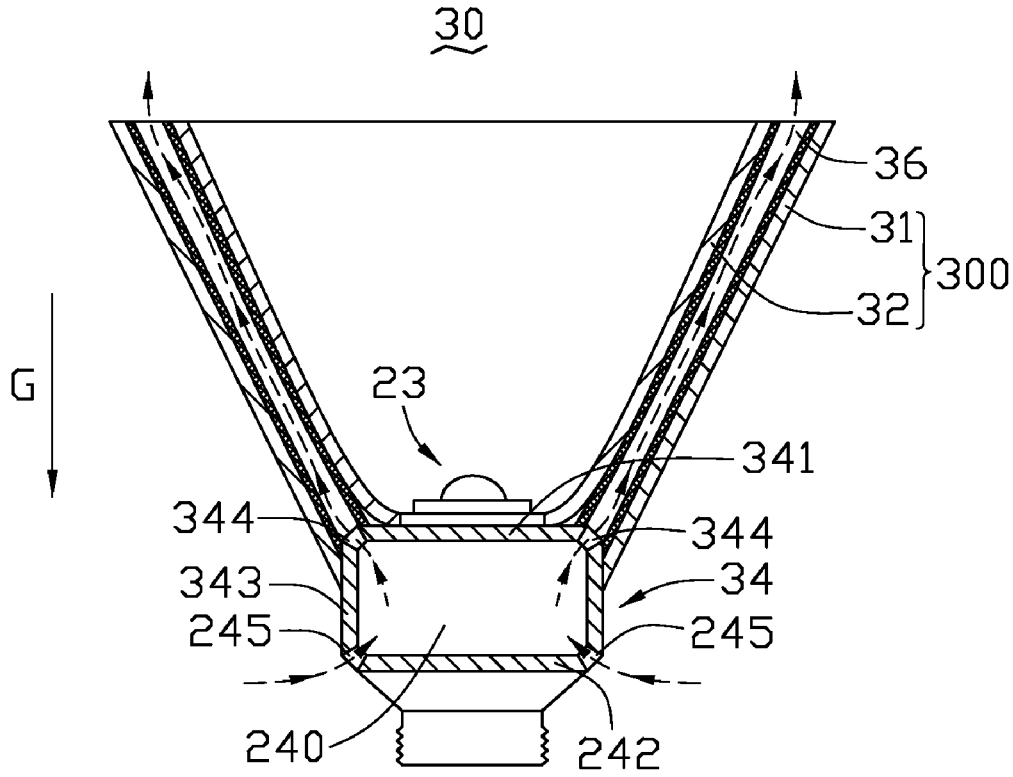
FIG. 5 is a cross-sectional view of the illuminating apparatus of FIG. 4, taken along line V-V thereof.

FIGS. 4 and 5 illustrate an illuminating apparatus 30 in accordance with a second preferred embodiment of the present invention. The illuminating apparatus 30 is similar to the illuminating apparatus 20 in the previous embodiment. In this embodiment, four hollow pipes 36 are disposed and evenly distributed in the space 25 between the exterior shell 31 and the interior shell 32 of the lamp cover 300 for severing as air channels. The air tank 34 defines four first air vents 344 at an intersection between the top wall 341 and the side wall 343 for communicating the chamber 240 of the air tank 34 with the four hollow pipes 36, respectively. When the illuminating apparatus 30 operates, warm air in the air tank 34 travels to the hollow pipes 36 through the four first air vents 344, and then into the ambient environment for dissipating heat away from the illuminating apparatus 30. Simultaneously, cool air in the ambient environment is absorbed into the air tank 34 through the second air vents 245.

Figure 6:
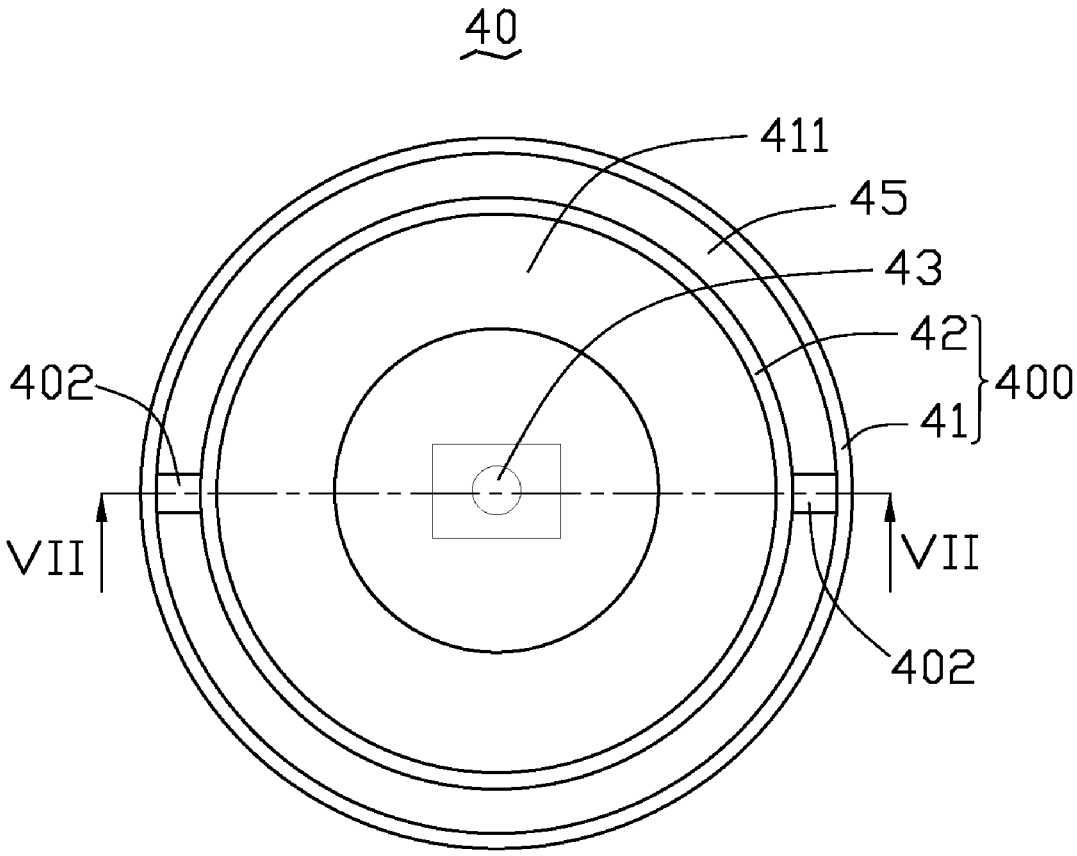
FIG. 6 is a top plan view of an illuminating apparatus in accordance with a third preferred embodiment of the present invention.
Figure 7:
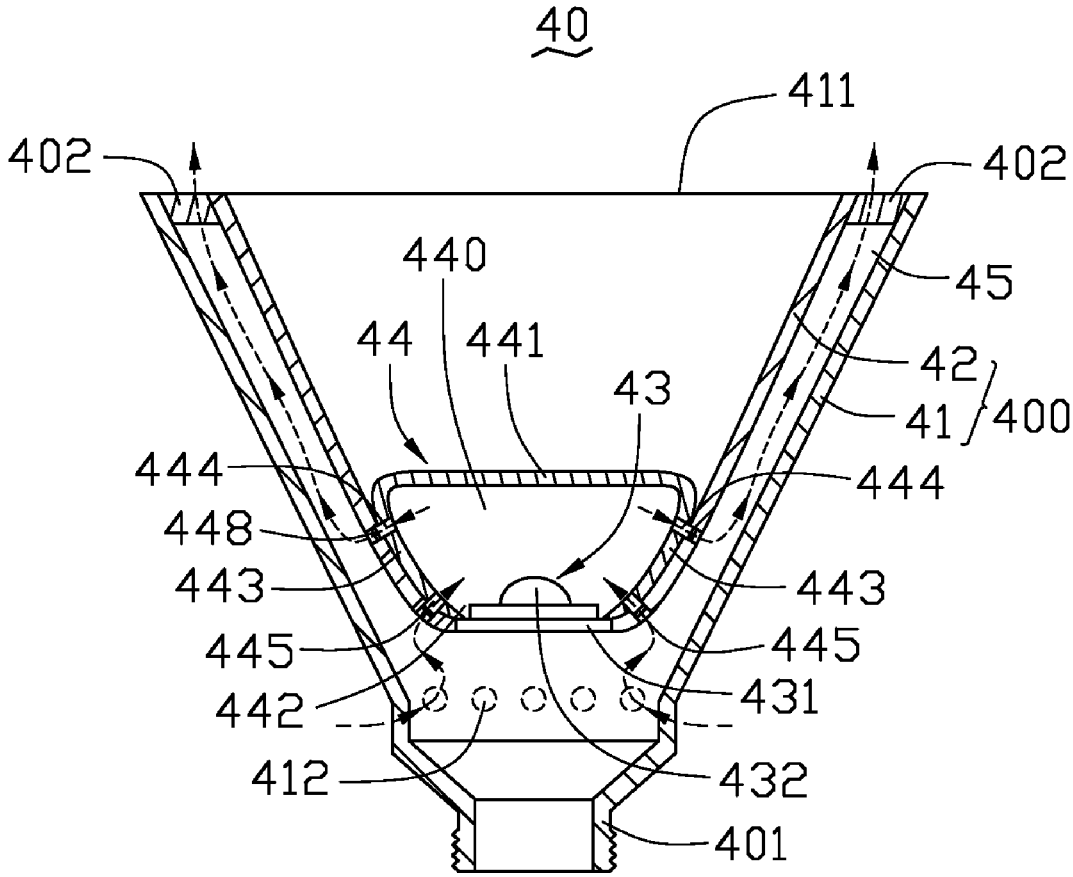
FIG. 7 is a cross-sectional view of the illuminating apparatus of FIG. 6, taken along line VII-VII thereof.

FIGS. 6 and 7 illustrate an illuminating apparatus 40 in accordance with a third preferred embodiment of the present invention. The illuminating apparatus 40 includes a lamp cover 400, an LED 43 disposed in the lamp cover 400 and an air tank 44 engaged with the lamp cover 400.

The lamp cover 400 includes an exterior shell 41 and an interior shell 42 aligned inside the exterior shell 41. The exterior shell 41 has a truncated conical shape and is hollow, defining an opening 411 at the wider end and the narrower end being contacted with a female socket 401. A plurality of air intake holes 412 are evenly distributed around a circumference of the narrower end of the exterior shell 41 for permitting cool air in the ambient environment to pass into the illuminating apparatus 40 therefrom.

The interior shell 42 is an optical reflector, such as a total internal reflector (TIR), to control the direction of the light emitted by the LED 43. The exterior shell 41 and the interior shell 42 define a space 45 therebetween for severing as an air channel. The interior shell 42 is engaged with the exterior shell 41 at the opening 411 of the exterior shell 41 by two supporting ribs 402. If desired, the supporting ribs 402 may be located at other locations, e.g., in the space 45. In addition, the number of the supporting ribs 402 may be variable, e.g., one or more.

The LED 43 is disposed at a bottom end of the interior shell 42. The LED 43 has a base 431 and a light emitting portion 432 configured on the base 431. The base 431 of the LED 43 is thermally contacted to a bottom end of the interior shell 42. It should be understood that if desired, a plurality of LEDs may be adopted to generate a predetermined brightness or a predetermined color of the light emitting out of the illuminating apparatus 40.

The air tank 44 has a top wall 441 facing to the light emitting portion 432 of the LED 43 and a side wall 443 connected with the top wall 441. The air tank 44 defines a chamber 440 therein and an opening 442 at a bottom thereof facing the top wall 441. The air tank 44 is aligned inside the bottom end of the interior shell 42, with an outer surface of the side wall 443 abutting on an inner surface of the interior shell 42. The LED 43 is received in the opening 442 of the air tank 44 and protrudes into the chamber 440 of the air tank 44.

The top wall 441 of the air tank 44 can penetrate light, and is made of a translucent or transparent material such as silicone, resin, glass, polymethyl methacrylate (PMMA), quartz and so on. An inner surface of the air tank 44 can be spread by a fluorescent powder or covered by a light filter. Alternatively, the side wall 443 of the air tank 44 may also be made of a translucent or transparent material.

The air tank 44 defines a plurality of first air vents 444 (only two first air vents are shown in FIG. 7) apart from the LED 43 and a plurality of second air vents 445 (only two second air vents are shown in FIG. 7) adjacent to the LED 43. Each first air vent 444 and each second air vent 445 extends through the interior shell 42, and communicates with the space 45 and the chamber 440 of the air tank 44. A diameter of each of the first air vents 444 substantially equals to that of each of the second air vents 445. The first air vents 444 and the second air vents 445 are disposed at different altitudes. Furthermore, a filtering unit 448 can be disposed at each first air vent 444 or each second air vent 445 to filter air for preventing the LED 43 from being contaminated.

When the illuminating apparatus 40 operates, the air in the air tank 44 is warmed by the heat generated from the LED 43. Warm air is lighter than cool air so that a buoyancy of the air in the air tank 44 is generated. Warm air rises due to the buoyancy and exits through the first air vents 444 into the space 45. Warm air then continues to rise along the space 45 and exits into the ambient environment, removing the heat from the illuminating apparatus 40 into the ambient environment in the process. Simultaneously, cool air in the ambient environment is absorbed into the air tank 44 through the plurality of air intake holes 412 and the second air vents 445 to replace warm air in the air tank 44. Thus, an air circulatory system is formed between the air in the air tank 44 and the ambient environment through the holes 412, the second air vents 445, the first air vents 444 and the space 45 for heat dissipation. The flow of air is illustrated in FIG. 7 by dashed arrows. At this time, the first air vent 444 and the second air vents 445 are used as air exhausting holes and air intake holes, respectively.

Figure 8:
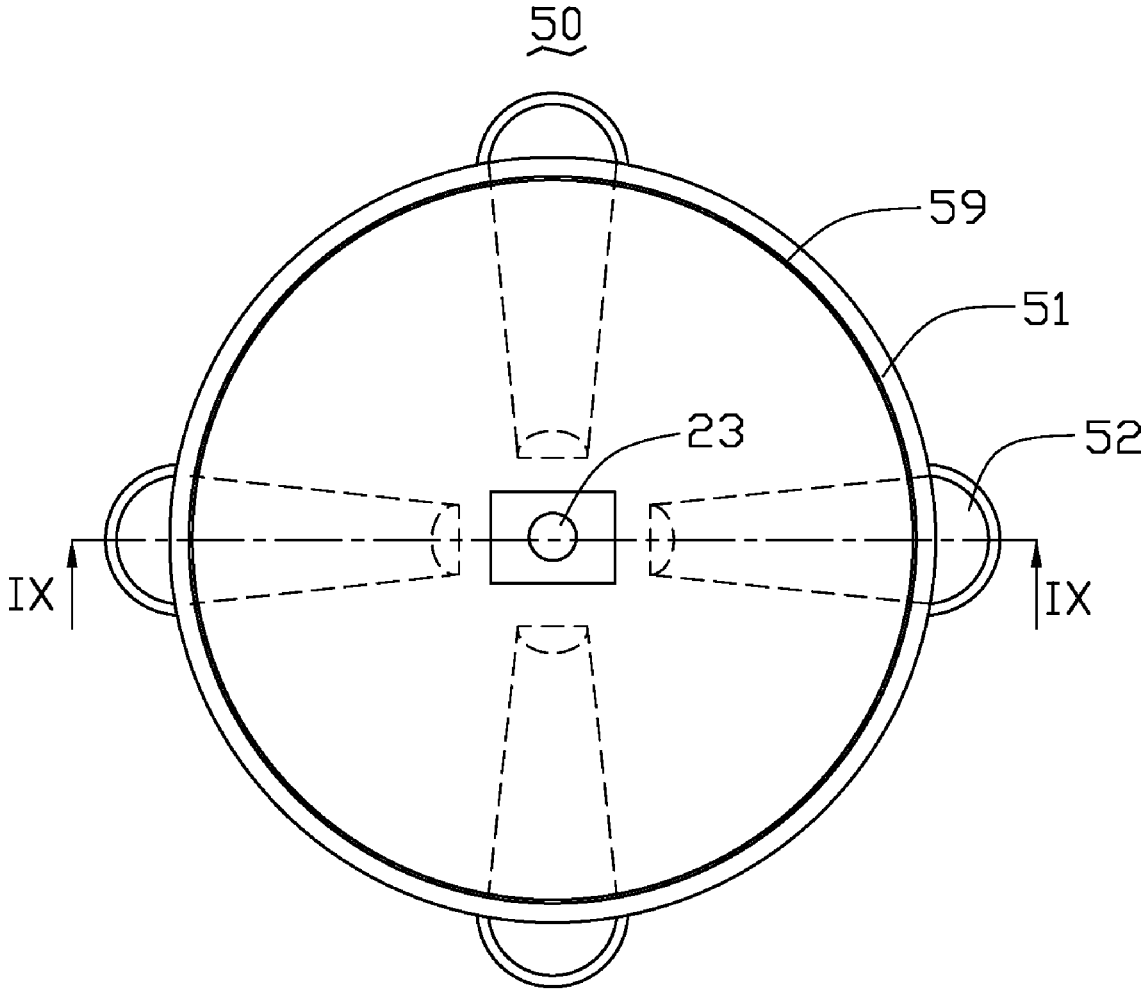
FIG. 8 is a top plan view of an illuminating apparatus in accordance with a fourth preferred embodiment of the present invention.
Figure 9:
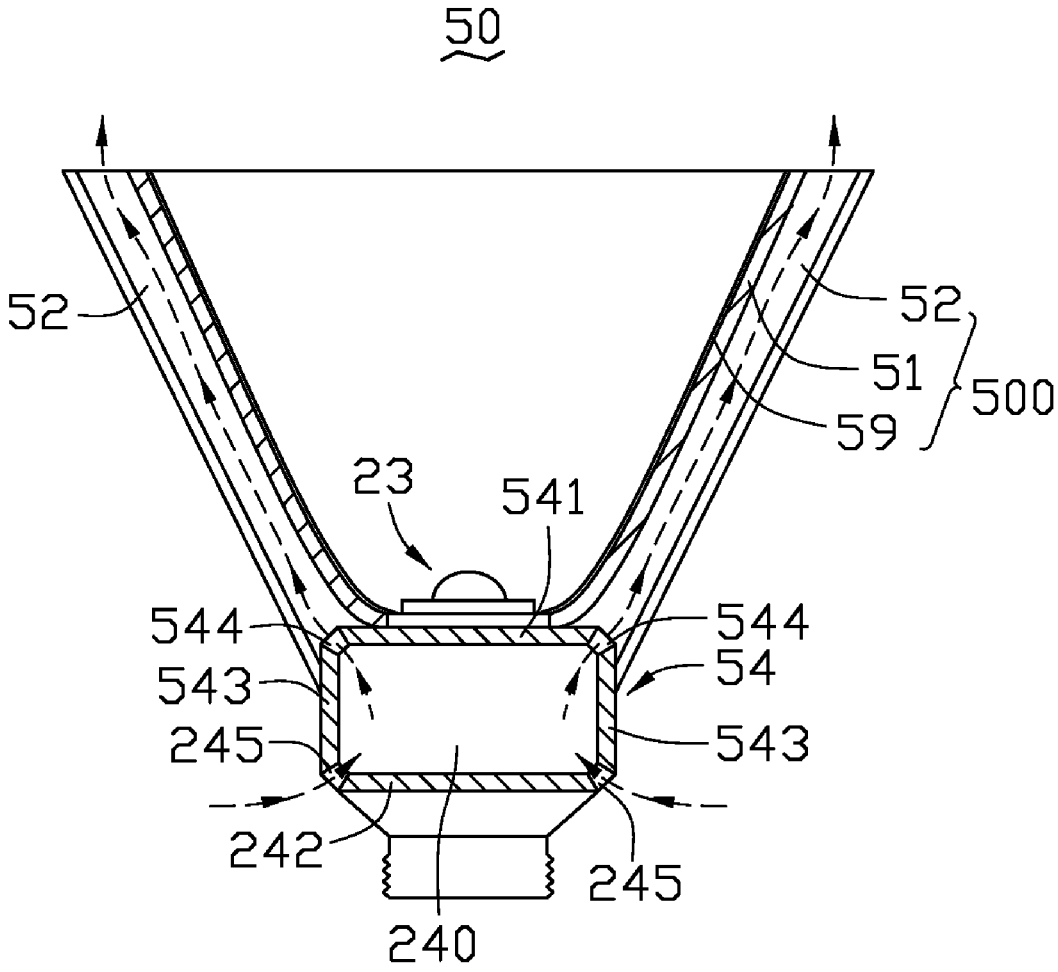
FIG. 9 is a cross-sectional view of the illuminating apparatus of FIG. 8, taken along line IX-IX thereof.

Referring to FIGS. 8 and 9, an illuminating apparatus 50 in accordance with a fourth preferred embodiment of the present invention is shown. The illuminating apparatus 50 is similar to the illuminating apparatus 20 in the previous first embodiment. In this embodiment, the lamp cover 500 includes a shell 51, a reflective film 59 spread on an inner surface of the shell 51 and four hollow pipes 52 disposed on an outer surface of the shell 51 for severing as air channel. The reflective film 59 can redirect the direction of the light emitted from the LED 23 and prevent light emitted from the LED 23 from being absorbed as much as possible. The air tank 54 defines four first air vents 544 at an intersection between the top wall 541 and the side wall 543 for communicating the chamber 240 of the air tank 54 with the four hollow pipes 52, respectively. When the illuminating apparatus 50 operates, warm air in the air 54 exits from the four first air vents 544 into the hollow pipes 52, and then into the ambient environment for taking heat away. Simultaneously, cool air in the ambient environment enters into the air tank 54 through the second air vents 245. The flow of air is illustrated in FIG. 9 by dashed arrows.

Figure 10:
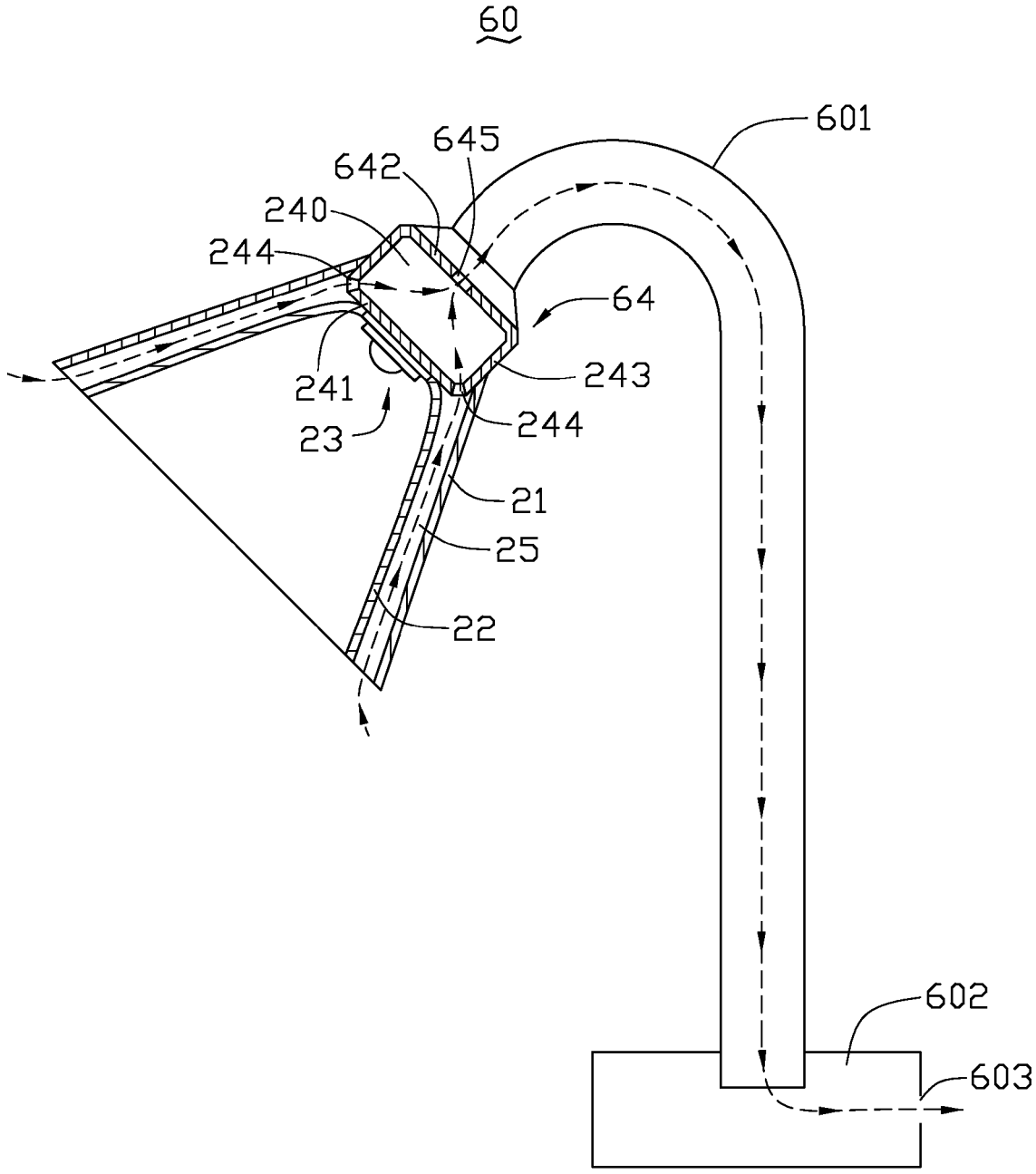
FIG. 10 is a cross-sectional view of an illuminating apparatus in accordance with a fifth preferred embodiment of the present invention.
Figure 11:
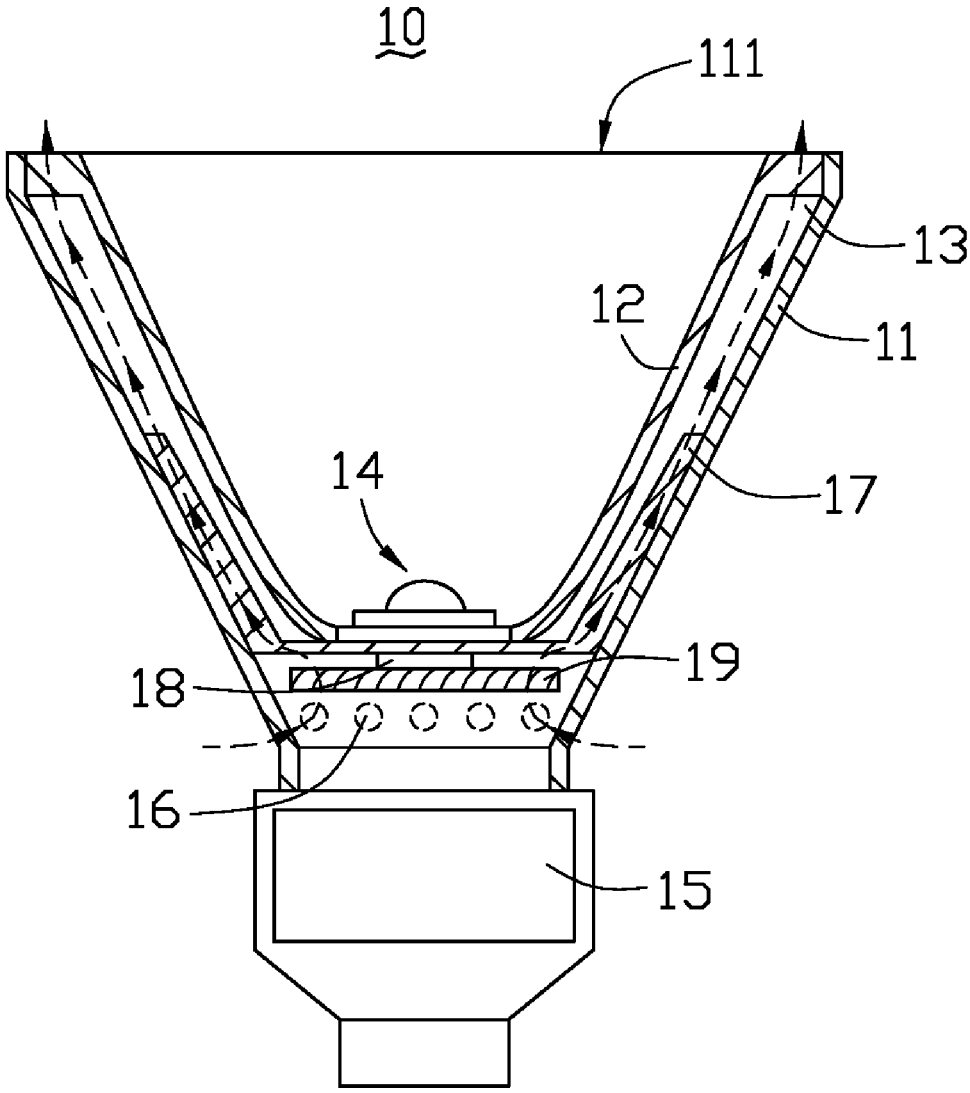
FIG. 11 (RELATED ART)
FIG. 11 is a cross-sectional view of an LED lamp in accordance with related art.

Referring FIG. 10 an illuminating apparatus 60 in accordance with a fifth preferred embodiment of the present invention is shown. The illuminating apparatus 60 is similar to the illuminating apparatus 20 in the previous first embodiment. In this embodiment, the illuminating apparatus 60 is connected to one end of a hollow supporting pole 601 and the other end of the supporting pole 601 is engaged with a base 602. If desired, the supporting pole 601 may be rigid or flexible. The air tank 64 defines a second air vent 645 in a central portion of the bottom wall 642 for communicating the chamber 240 of the air tank 64 with the hollow supporting pole 601. It should be understood that the number of the second air vent 645 is not limited to a single one.

When the illuminating apparatus 60 operates, warm air in the air tank 64 exits from the second air vent 645 into the hollow supporting pole 601, and then into the ambient environment through a through hole 603 defined in the base 602 for taking heat away. Simultaneously, cool air in the ambient environment enters into the air tank 34 through the space 25 and the first air vents 244. The flow of air is illustrated in FIG. 10 by dashed arrows. At this time, the first air vents 244 and the second air vent 645 are used as air intake hole and air exhausting holes, respectively. Alternatively, the through hole 603 may be defined at other positions, such as at the hollow supporting pole 601, so as to communicate the chamber of the air tank 64 with the ambient environment.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An illuminating apparatus comprising:

a lamp cover having a first end and an opposite second end, the lamp cover tapering from the first end to the second end, the lamp cover defining at least one air channel therein, the at least one air channel running from the first end to the second end of the lamp cover;

at least one solid-state light emitting component disposed in the lamp cover at the second end thereof; and an air tank having a chamber therein, the air tank in thermal contact with the at least one solid-state light emitting component, the air tank having at least one first air vent and at least one second air vent, the chamber in communication with the at least one air channel via the at least one first air vent, the chamber in communication with an ambient environment via the at least one second air vent, the at least one first air vent and the at least one second air vent configured for being disposed at different altitudes, wherein the lamp cover includes an interior shell, an exterior shell surrounding the interior shell, and at least one hollow pipe disposed between the exterior shell and the interior shell for severing as the at least one air channel.

2. An illuminating apparatus comprising:

a lamp cover having a first end and an opposite second end, the lamp cover tapering from the first end to the second end, the lamp cover defining at least one air channel therein, the at least one air channel running from the first end to the second end of the lamp cover;

at least one solid-state light emitting component disposed in the lamp cover at the second end thereof;

an air tank having a chamber therein, the air tank in thermal contact with the at least one solid-state light emitting component, the air tank having at least one first air vent and at least one second air vent, the chamber in communication with the at least one air channel via the at least one first air vent, the chamber in communication with an ambient environment via the at least one second air vent, the at least one first air vent and the at least one second air vent configured for being disposed at different altitudes; and a hollow supporting pole and a base, one end of the supporting pole being connected with the base and the other end of the supporting pole being connected to the air tank, the chamber of the air tank in communication with the hollow supporting pole, at least one through hole being defined in the hollow supporting pole or the base.

3. An illuminating apparatus comprising:

a lamp cover having a first end and an opposite second end, the lamp cover tapering from the first end to the second end, the lamp cover defining at least one air channel therein, the at least one air channel running from the first end to the second end of the lamp cover;

at least one solid-state light emitting component disposed in the lamp cover at the second end thereof; and an air tank having a chamber therein, the air tank in thermal contact with the at least one solid-state light emitting component, the air tank having at least one first air vent and at least one second air vent, the chamber in communication with the at least one air channel via the at least one first air vent, the chamber in communication with an ambient environment via the at least one second air vent, the at least one first air vent and the at least one second air vent configured for being disposed at different altitudes, wherein the air tank includes a light-permeable top wall and a side wall connected with the top wall, the air tank being disposed in the lamp cover at the second end thereof, an opening defined in a bottom of the air tank, the at least one solid-state light emitting component being received in the opening and protruding into the chamber of the air tank, the side wall in thermal contact with the shell.

4. The illuminating apparatus as claimed in claim 3, wherein the at least one first air vent is spaced apart from the at least one solid-state light emitting component and the at least one second air vent is located adjacent to the at least one solid-state light emitting component, the at least one first air vent and the at least one second air vent in communication with the at least one air channel.

5. The illuminating apparatus as claimed in claim 4, wherein a filtering unit is disposed at the at least one first air vent or the at least one second air vent configured for filtering air.

6. The illuminating apparatus as claimed in claim 4, wherein at least one air intake hole is defined under the air tank to communicate with the at least one second air vent.

* * * * *